United States Patent [19]

Hawken et al.

[11] 4,277,722

[45] Jul. 7, 1981

[54] CATHODE RAY TUBE HAVING LOW VOLTAGE FOCUS AND DYNAMIC CORRECTION

[75] Inventors: Kenneth W. Hawken, Dundee; Bozidar Janko, Portland, both of Oreg.

[73] Assignee: Tektronix, Inc., Beaverton, Oreg.

[21] Appl. No.: 38,606

[22] Filed: May 14, 1979

Related U.S. Application Data

[63] Continuation-in-part of Ser. No. 878,042, Feb. 15, 1978, abandoned.

[51] Int. Cl.[3] ..... H01J 29/62

[52] U.S. Cl. ..... 315/31 R; 315/16; 315/382

[58] Field of Search ..... 315/16, 382, 31 R

[56] References Cited

U.S. PATENT DOCUMENTS

| | | | |
|---|---|---|---|
| 2,123,011 | 7/1938 | Keyston et al. | 315/382 X |
| 2,931,937 | 4/1960 | Dufour | 315/16 X |
| 3,319,110 | 5/1967 | Schlesinger | 315/382 X |

*Primary Examiner*—Malcolm F. Hubler

[57] ABSTRACT

A cathode ray tube comprises two electron lens means in combination to crossover the electron beam at a second crossover between the two electron lens means with one of the two lens means having a variable voltage applied thereto to dynamically control the location of the beam crossover in order to focus the beam onto a display screen at any location away from the screen center.

17 Claims, 4 Drawing Figures

CATHODE RAY TUBE HAVING LOW VOLTAGE FOCUS AND DYNAMIC CORRECTION

CROSS REFERENCE TO RELATED APPLICATION

This application is a continuation-in-part application of U.S. patent application Ser. No. 878,042, filed Feb. 15, 1978, now abandoned.

BACKGROUND OF THE INVENTION

Conventional magnetic scan cathode ray tubes for use to display pictorial images use a single lens means for focussing the electron beam. No correction is applied to the beam to cause the beam to be in focus over the entire display screen. Thus, as the electron beam is moved away from the screen center, it becomes slightly defocussed with the greatest amount of defocussing occurring at the areas of the screen that are furtherest from the screen center.

For display of alphanumeric information, higher resolution is required, and a bipotential lens means is generally used with a nominal focussing voltage to focus the electron beam at screen center being about 3,000 or more volts. To dynamically correct the beam focus when using a bipotential lens means when the electron beam is moved away from the screen center, a voltage of about 500 volts is added to the existing voltage on the bipotential lens means. The amplifier that is applying this voltage to the bipotential lens means must be insulated due to its high voltage operation and more power is required to dynamically correct the focus.

U.S. Pat. No. 3,603,839 employs several lens means for focussing the electron beam and a second crossover of the beam is formed to increase the beam current through a shadowmask color cathode ray tube. The voltages required to focus the second crossover are not of low value nor is the lens means that effects the second crossover used to correct for deflection defocussing.

SUMMARY OF THE INVENTION

The present invention relates to electron discharge devices of the cathode ray tube type and more particularly to applying a variable low voltage to a first lens means to control the position of a second electron beam crossover for dynamically correcting deflection defocussing.

The present invention can be realized in a cathode ray tube by the use of unipotential lens means in combination with bipotential lens means with the unipotential lens means having variable low voltage applied thereto to control the position of the focussing of the second beam crossover relative to the bipotential lens means to dynamically correct the focus of the beam at any position on the display screen.

An object of the present invention is the provision of a cathode ray tube which comprises unipotential lens means in combination with bipotential lens means with the unipotential lens means controlling the second crossover of the electron beam along the bipotential lens means.

A further object of the present invention is to provide a cathode ray tube having dual unipotential lens means with one of the unipotential lens means controlling the second crossover of the electron beam therealong.

An additional object of the present invention is the provision of a cathode ray tube having unipotential lens means in combination with bipotential lens means with the unipotential lens means having beam-limiting means to shape the electron beam and control the current thereof.

Still a further object of the present invention is to provide a cathode ray tube including unipotential and bipotential lens means, the unipotential lens means having variable low voltage applied thereto for controlling the second crossover of the electron beam relative to the bipotential lens means and the bipotential lens means having variable high voltage applied thereto for controlling the color of information that will be displayed by the screen.

A still additional object of the present invention is the provision of a cathode ray tube including low voltage control means as part of the deflection means for deriving a variable low voltage and applying the variable low voltage to focussing electrode means of electrostatic lens means for dynamically controlling a second crossover of the electron beam for focussing the electron beam onto screen means.

Still another object of the present invention is to provide a cathode ray tube including low voltage control means as part of the intensity means and the deflection means for deriving a variable low voltage and applying the variable low voltage to focussing electrode means of electrostatic lens means for dyanmically controlling a second crossover of the electron beam for focussing the electron beam onto a screen means.

BRIEF DESCRIPTION OF THE DRAWINGS

The above objects and other objects, advantages and features of the present invention will appear from the following detailed description of embodiments thereof when taken in conjunction with the accompanying drawings of which.

DETAILED DESCRIPTION OF THE INVENTION

Figure 1:
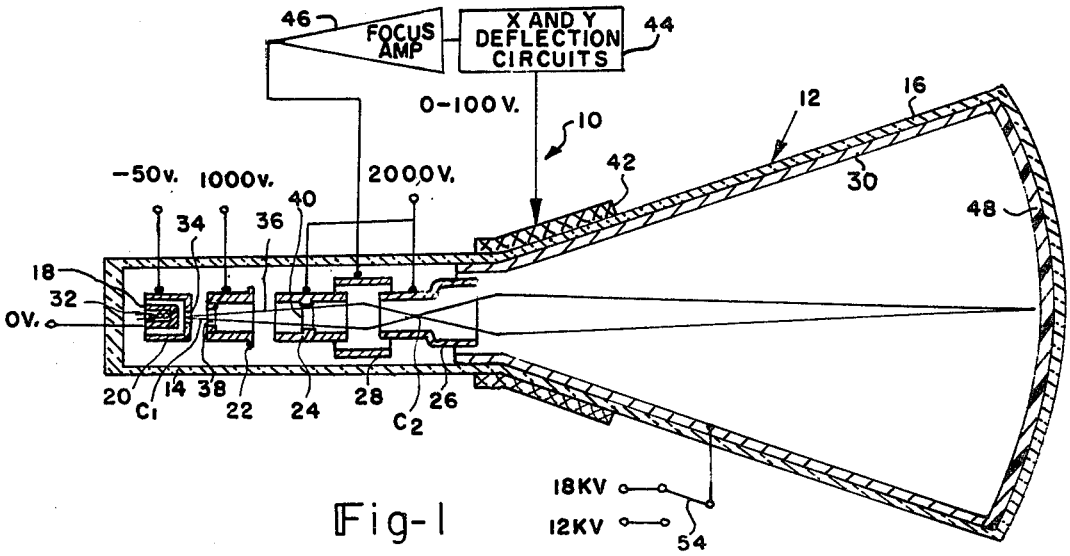
FIG. 1 is a longitudinal cross-sectional view of a cathode ray tube utilizing the present invention.

Turning now to FIG. 1, a cathode ray tube 10 includes a glass envelope 12 which has a neck section 14 and a funnel section 16. An electron beam forming structure is provided in neck section 14 which includes a cathode 18, a grid 20, a first anode 22, a unipotential lens which comprises elements 24 and 26, a focussing electrode 28 and a bipotential lens which includes element 26 and conductive coating 30 on the inside surface of funnel section 16.

Cathode 18 is connected to ground or zero volts and it has a heater coil 32 therein. Grid 20 is connected to −50 volts and it has an aperture 34 through which the electron beam 36 emanating from cathode 18 passes. Aperture 34 shapes electron beam 36 and determines the current density thereof, whereas grid 20 acts on electron beam 36 to converge it thereby causing it to form a first crossover $C_1$ between grid 20 and first anode 22.

First anode 22 is connected to 1,000 volts and it has a beam-forming aperture 38 through which electron beam 36 passes. The electric field developed by anode 22 causes electron beam 36 to diverge as it moves into element 24 of the unipotential lens means. Elements 24 and 26 of the unipotential lens means are connected to 2,000 volts. Element 24 has a beam-forming aperture 40 through which beam 36 passes, and the electric field of element 24 causes beam 36 to diverge as it moves therealong and into focussing electrode 28.

Horizontal and vertical deflection coils 42 of conventional design are provided on envelope 12 and they are operated by deflection signals being generated by conventional X and Y deflection circuits 44. Signals are derived from deflection circuits 44 and transmitted to focus amplifier 46 of conventional design and the output from focus amplifier 46 is connected to focussing electrode 28. The voltage of the signals from focus amplifier 46 and being applied to focussing electrode 28 vary between 0–100 volts and the level of the voltage depends on the deflection that is being applied to the electron beam 36 by deflection coils 42. As the deflection of electron beam 36 moves away from the tube axis, the voltage on focussing electrode 28 will vary and this will cause the electric-field of focussing electrode 28 to vary thereby causing electron beam 36 to converge at a second crossover $C_2$ within element 26 depending on the voltage on focussing electrode 28. Thus, the unipotential lens forms an image of the second crossover $C_2$ between the unipotential lens and the bipotential lens.

Conductive coating 30 is connected to a high voltage, e.g. 18 KV, and conductive coating 30 is also engaged with a conventional fluorescent screen 48 that is formed from a P4 black and white phosphor so that screen 48 is also connected to 18 KV. The second crossover $C_2$ of beam 36 is focussed onto any displayable location on fluorescent screen 48 by the bipotential lens. Screen 48 can of course use other phosphors to provide whatever color that is desired.

Thus, in accordance with the present invention, correction for deflection defocussing is effected by changing the voltage on focussing electrode 28 which controls the position of the second crossover $C_2$ of the electron beam relative to the unipotential lens means. The position of the second crossover is very sensitive to the strength of the unipotential lens means; hence a low dynamic correction voltage is required which is close to ground potential. In this regard, focus amplifier 46 need not have high voltage requirements and require insulation therefor which constitutes cost and power savings in dynamic focus correction amplifier design and construction.

Figure 2:
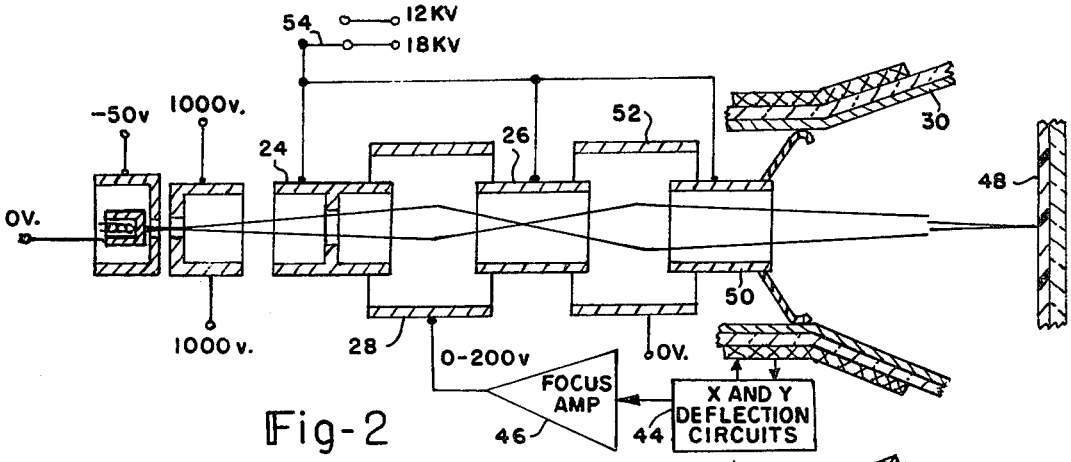
FIG. 2 is a longitudinal cross-sectional view of an alternative embodiment of the present invention.

FIG. 2 illustrates an alternative embodiment wherein like reference characters are used to identify like elements. In this FIG. 2 embodiment, a second unipotential lens is used instead of a bipotential lens. Elements 24 and 26 of the first unipotential lens and element 50 of the second unipotential lens as well as conductive coating 30 are connected together and to 18 KV. Focussing electrode 28 of the first unipotential lens means is connected to the output of focus amplifier 46 and the voltage from amplifier 46 can range between 0–200 volts in the same manner as described in conjunction with the embodiment of FIG. 1. Electrode 52 of the second unipotential lens is connected to zero volts. The operation of the cathode ray tube is the same as that of the cathode ray tube of FIG. 1.

Figure 3:
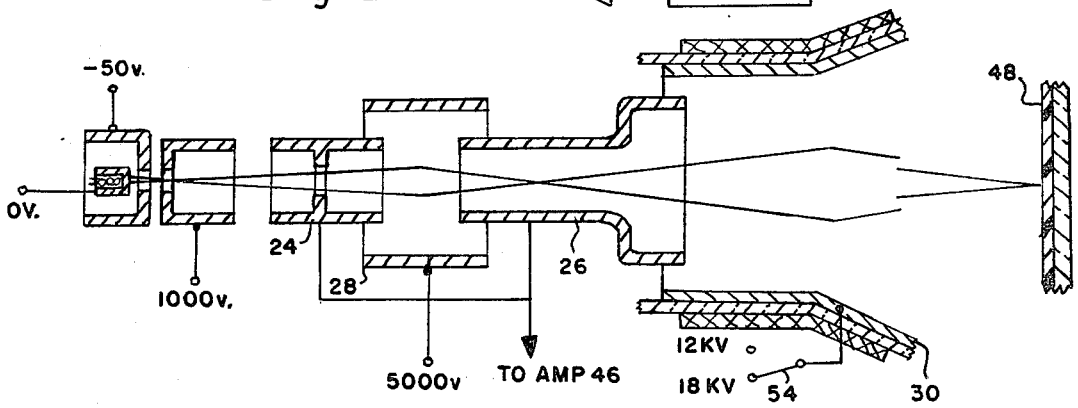
FIG. 3 illustrates the arrangement of electrodes of another embodiment of the present invention.

FIG. 3 illustrates another embodiment of the electrode arrangement of the present invention wherein like reference characters are also used to identify like elements. In this FIG. 3 embodiment which is identical in construction as the electrode arrangement of FIG. 1 except that elements 24 and 26 of the unipotential lens are connected to focus amplifier 46 which applies 100–500 volts thereon and electrode 28 has a fixed voltage of 5,000 volts connected to it. Thus, instead of using electrode 28 for dynamic focus correction to electron beam 36, the unipotential lens can be operated at its high voltage operating mode, e.g. 5,000 volts, to reduce beam aberrations and electrodes 24 and 26 can be operated at a low voltage and adjusted for deflection defocussing. Electrodes 24 and 26 are therefore the focussing electrode means and they receive varying correcting voltage from focus amplifier 46.

Screen 48 can be formed from a conventional penetron phosphor which emits red and green colors or any desired colors. Conductive coating 30 in the cathode ray tubes of FIGS. 1–3 can be selectively connected to either 18 KV or 12 KV via switch means 54 in order to display the information in a red color when conductive coating 30 is connected to 18 KV. The color can vary between red, orange, yellow and green depending on the voltage that is applied to conductive coating 30 and hence to screen 48. Switch means 54 can take any desirable form such as electronics or manual.

In the cathode ray tube of FIG. 1, switching the voltage on conductive coating 30 from 18 KV to 12 KV or vice versa via switch means 54 will also require changing the voltage at the same time on focussing electrode 28 to assure proper correction for defocussing of electron beam 36. The voltage will likewise have to be changed on focussing electrodes 24 and 26 in the cathode ray tube of FIG. 3 when conductive coating 30 is changed from 18 KV to 12 KV or vice versa to assure proper correction for defocussing of electron beam 36. In the case of the cathode ray tube of FIG. 2, switching the voltage on conductive coating 30 from 18 KV to 12 KV or vice versa via switch means 54 will not require refocussing of the beam at the second crossover. Thus, no change of the voltage of focussing electrode 28 in the cathode ray tube of FIG. 2 is required when the voltage is switched on conductive coating 30 from one voltage level to the next, whereas the change of the voltage on focussing electrode 28 in the cathode ray tube of FIG. 1 is required, when such voltage level change occurs.

Figure 4:
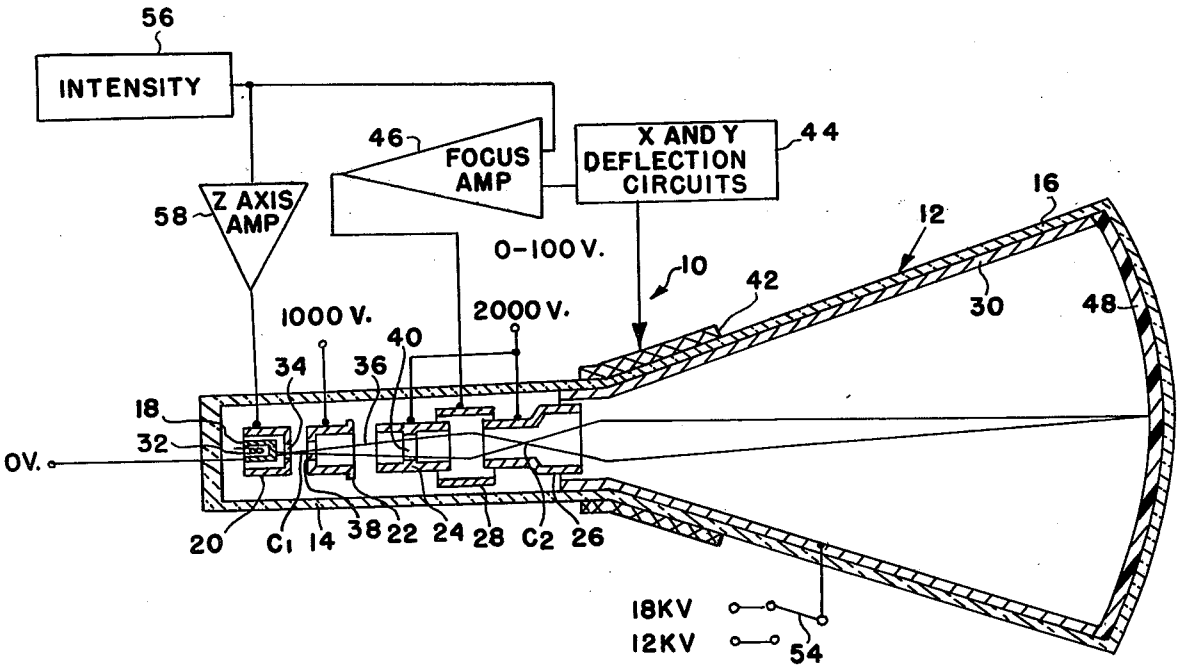
FIG. 4 is a view similar to FIG. 1 illustrating a further embodiment of the present invention.

FIG. 4 is similar to FIG. 1 except that an intensity circuit 56 generates an intensity signal which is transmitted to grid 20 via z-axis amplifier 58 of conventional design. The intensity signal can be derived from a character generator or a composite video signal and it varies the intensity of the information being displayed on screen 48 by electron beam 36. The intensity signal is also transmitted to focus amplifier 46 along with the signals derived from deflection circuits 44 in order to properly focus the electron beam via focussing electrode 28 at the second crossover $C_2$ at all intensity levels and the deflection being applied to electron beam 36.

The intensity circuit 56 and z-axis amplifier 58 can be used in the embodiments of FIGS. 2 and 3 if desired.

While the z-axis amplifier is connected to grid 20, it can be connected to cathode 18 instead if desired.

While the unipotential and bipotential lens means have been disclosed as being electrostatic, magnetic lens means can be used in their place to achieve the same result.

It can readily be discerned from the foregoing that the application of a low variable voltage to a focussing electrode of a unipotential lens means controls the position of a second crossover of the electron beam thereby dynamically controlling the focus along adjacent lens means.

While embodiments of the present invention have been shown and described, it will be apparent to those skilled in the art that changes and modifications may be made without departing from the present invention in its broad aspects. The appended claims are therefore intended to cover all such changes and modifications as fall within the true spirit and scope of the present invention.

The invention is claimed in accordance with the following:

1. An electron discharge device comprising:

beam-forming means including cathode means for emitting an electron beam, electrode means for forming said electron beam into a first crossover, first and second lens means along which said electron beam moves, said first lens means including focussing electrode means having a variable focussing voltage continuously applied thereto for dynamically controlling a second crossover of said electron beam relative to said second lens means for focussing said electron beam; and screen means onto which the electron beam is focussed from said second crossover by said second lens means.

2. An electron discharge device according to claim 1 wherein said first lens means defines a unipotential lens means.

3. An electron discharge device according to claim 1 wherein said second lens means defines a bipotential lens means.

4. An electron discharge device according to claim 1 wherein said second lens means defines a unipotential lens means.

5. An electron discharge device according to claim 1 wherein said first lens means includes beam-limiting aperture means.

6. An electron discharge device according to claim 1 wherein said first and second lens means are electrostatic lens means.

7. An electron discharge device according to claim 1 wherein said second lens means is a bipotential lens means and said screen means is monochromatic.

8. An electron discharge device according to claim 1 wherein said second lens means is a bipotential lens means and said screen means is color.

9. An electron discharge device according to claim 1 wherein said second lens means is a unipotential lens means and said screen means is monochromatic.

10. An electron discharge device according to claim 1 wherein said second lens means is a unipotential lens means and said screen means is color.

11. An electron discharge device according to claim 1 wherein said first lens means includes first and second electrode means connected to a fixed voltage and a third electrode means connected to said focussing voltage.

12. An electron discharge device according to claim 1 wherein said first lens means includes first and second electrode means connected to said focussing voltage and a third electrode means connected to a fixed voltage.

13. An electron discharge device according to claim 1 wherein said focussing electrode means has a lower voltage than said first and second lens means.

14. An electron discharge device according to claim 13 wherein said lower voltage is from 0–200 volts.

15. An electron discharge device comprising:

beam-forming means including cathode means for emitting an electron beam, electrode means for forming said electron beam into a first crossover, first and second lens means along which said electron beam moves;

screen means onto which said electron beam engages;

deflection means for deflecting said electron beam over said screen means in accordance with input information signals being applied to said deflection means to display information by said screen means corresponding to the input information signals;

focussing electrode means as part of said first lens means; and means for deriving a variable focussing voltage from said deflection means and applying said variable focussing voltage to said focussing electrode means for dynamically controlling a second crossover of said electron beam relative to said second lens means for focussing said electron beam onto said screen means at any location thereover.

16. A electron discharge device according to claim 15 wherein means are connected to said beam-forming means to apply an intensity signal thereto and also to said means for deriving a variable focussing voltage.

17. An electron discharge device according to claim 16 wherein said means to apply an intensity signal is connected to grid means of said beam-forming means.

* * * * *